US012276279B2

(12) United States Patent
Kato et al.

(10) Patent No.: US 12,276,279 B2
(45) Date of Patent: Apr. 15, 2025

(54) ELECTRIC COMPRESSOR

(71) Applicant: KABUSHIKI KAISHA TOYOTA JIDOSHOKKI, Aichi (JP)

(72) Inventors: Takahiro Kato, Kariya (JP); Ryuji Watanabe, Kariya (JP); Noritaka Nishimori, Kariya (JP); Takahiro Hoshida, Kariya (JP); Takayuki Kato, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 156 days.

(21) Appl. No.: 18/123,611

(22) Filed: Mar. 20, 2023

(65) Prior Publication Data

US 2023/0313799 A1 Oct. 5, 2023

(30) Foreign Application Priority Data

Mar. 30, 2022 (JP) ..... 2022-057338

(51) Int. Cl.
*F04C 29/06* (2006.01)
*F04C 18/02* (2006.01)

(52) U.S. Cl.
CPC ..... *F04C 18/0215* (2013.01); *F04C 29/06* (2013.01); *F04C 2240/30* (2013.01); *F04C 2240/403* (2013.01)

(58) Field of Classification Search
CPC ..... F04C 2240/30; F04C 2240/403; F04C 22/40; F04C 29/06; F04C 29/063; F04B 53/001–002; F04B 53/16; F04B 39/121
See application file for complete search history.

(56) References Cited

U.S. PATENT DOCUMENTS 5,588,810 A * 12/1996 DiFlora ..... F04B 39/0033 181/403
2005/0274569 A1* 12/2005 Seel ..... F04B 39/121 181/202

(Continued)

FOREIGN PATENT DOCUMENTS

DE 102021107864 A1 9/2021
DE 102021109148 A1 10/2021

(Continued)

OTHER PUBLICATIONS

Japanese Office Action in counterpart Japanese Application No. 2022-057338, dated Jan. 21, 2025 (along with English translation thereof).

(Continued)

*Primary Examiner* — Thomas Fink
(74) *Attorney, Agent, or Firm* — Greenblum & Bernstein, P.L.C.

(57) ABSTRACT

An electric compressor includes a compression member configured to compress fluid, an electric motor configured to drive the compression member, an inverter configured to drive the electric motor, a housing accommodating the compression member, the electric motor, and the inverter, and a soundproof cover covering the housing. The housing includes a plurality of housing elements. The soundproof cover has a facing portion facing the housing. The facing portion has a groove that surrounds a boundary between two of the housing elements that are adjacent to each other and is distant from the boundary.

13 Claims, 7 Drawing Sheets

(56) References Cited

U.S. PATENT DOCUMENTS

| | | | | |
|---|---|---|---|---|
| 2009/0283356 | A1* | 11/2009 | Tsugihashi | G10K 11/172 181/207 |
| 2015/0061174 | A1* | 3/2015 | Holmstrom | F02B 77/13 181/294 |
| 2015/0214805 | A1* | 7/2015 | Kobayashi | F04B 39/121 310/71 |
| 2021/0305879 | A1 | 9/2021 | Nishimori et al. | |
| 2022/0243711 | A1* | 8/2022 | Kato | F04B 39/0033 |
| 2022/0307506 | A1* | 9/2022 | Nishimori | F04B 35/04 |
| 2023/0287887 | A1* | 9/2023 | Awa | F04B 39/121 |

FOREIGN PATENT DOCUMENTS

| | | | | | |
|---|---|---|---|---|---|
| JP | U1 1983-073975 | A | | 5/1983 | |
| JP | H05-321839 | A | | 12/1993 | |
| JP | 2000-193274 | A | | 7/2000 | |
| JP | 2004-232523 | A | | 8/2004 | |
| JP | 2009014228 | A | * | 1/2009 | F04B 39/0033 |
| JP | 2013-064343 | A | | 4/2013 | |
| JP | 2019-173656 | A | | 10/2019 | |
| JP | 2020-159350 | A | | 10/2020 | |

OTHER PUBLICATIONS

German Office Action in counterpart Application No. 10 2023 104 300.5 issued on Jan. 22, 2025 (along with translation thereof).

* cited by examiner

ELECTRIC COMPRESSOR

CROSS-REFERENCE TO RELATED APPLICATION

This application claims priority to Japanese Patent Application No. 2022-057338 filed on Mar. 30, 2022, the entire disclosure of which is incorporated herein by reference.

BACKGROUND ART

The present disclosure relates to an electric compressor.

An electric compressor includes a compression member, an electric motor, an inverter, and a cylindrical housing. The compression member is configured to compress fluid. The electric motor drives the compression member. The inverter drives the electric motor. The housing accommodates the compression member, the electric motor, and the inverter. A direction in which an axis of the housing extends is defined as an axial direction.

For example, in an electric compressor described in Japanese Patent Application Publication No. 2019-173656 (Publication 1), the housing includes a plurality of housing elements. The housing is dividable into the plurality of housing elements in the axial direction.

For example, a refrigerant compressor described in Japanese Patent Application Publication No. H5-321839 (Publication 2) includes a soundproof cover covering an outer peripheral face of a casing as a housing.

To reduce noise of the electric compressor described in the Publication 1, a person skilled in the art may cover the housing with the soundproof cover described in the Publication 2.

The soundproof cover may be made of elastically deformable sound absorbing material, for example, urethane material. The soundproof cover made of such material is apt to absorb moisture from a surrounding environment.

For example, depending on the environment under which the electric compressor is used, the soundproof cover absorbs a lot of moisture. The moisture absorbed in the soundproof cover remains near the housing, which may corrode the housing. In particular, when the moisture absorbed in the soundproof cover remains at a boundary between two adjacent housing elements, corrosion on an outer surface of the housing may proceed into the housing.

SUMMARY

In accordance with an aspect of the present disclosure, there is provided an electric compressor that includes a compression member configured to compress fluid, an electric motor configured to drive the compression member, an inverter configured to drive the electric motor, a housing accommodating the compression member, the electric motor, and the inverter, and a soundproof cover covering the housing. The housing includes a plurality of housing elements. The soundproof cover has a facing portion facing the housing. The facing portion has a groove that surrounds a boundary between two of the housing elements that are adjacent to each other and is distant from the boundary.

In accordance with another aspect of the present disclosure, there is provided an electric compressor that includes a compression member configured to compress fluid, an electric motor configured to drive the compression member, an inverter configured to drive the electric motor, a housing accommodating the compression member, the electric motor, and the inverter, and a soundproof cover covering the housing. The housing includes a plurality of housing elements. The soundproof cover has a facing portion facing the housing. The soundproof cover further has a spacer that keeps a boundary between two of the housing elements that are adjacent to each other apart from the facing portion.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

First Embodiment

The following will describe a first embodiment of an electric compressor according to the present disclosure with reference to FIGS. 1 to 4. The electric compressor in the first embodiment is used for a vehicle air conditioner, for example.

<Electric Compressor>

Figure 1:
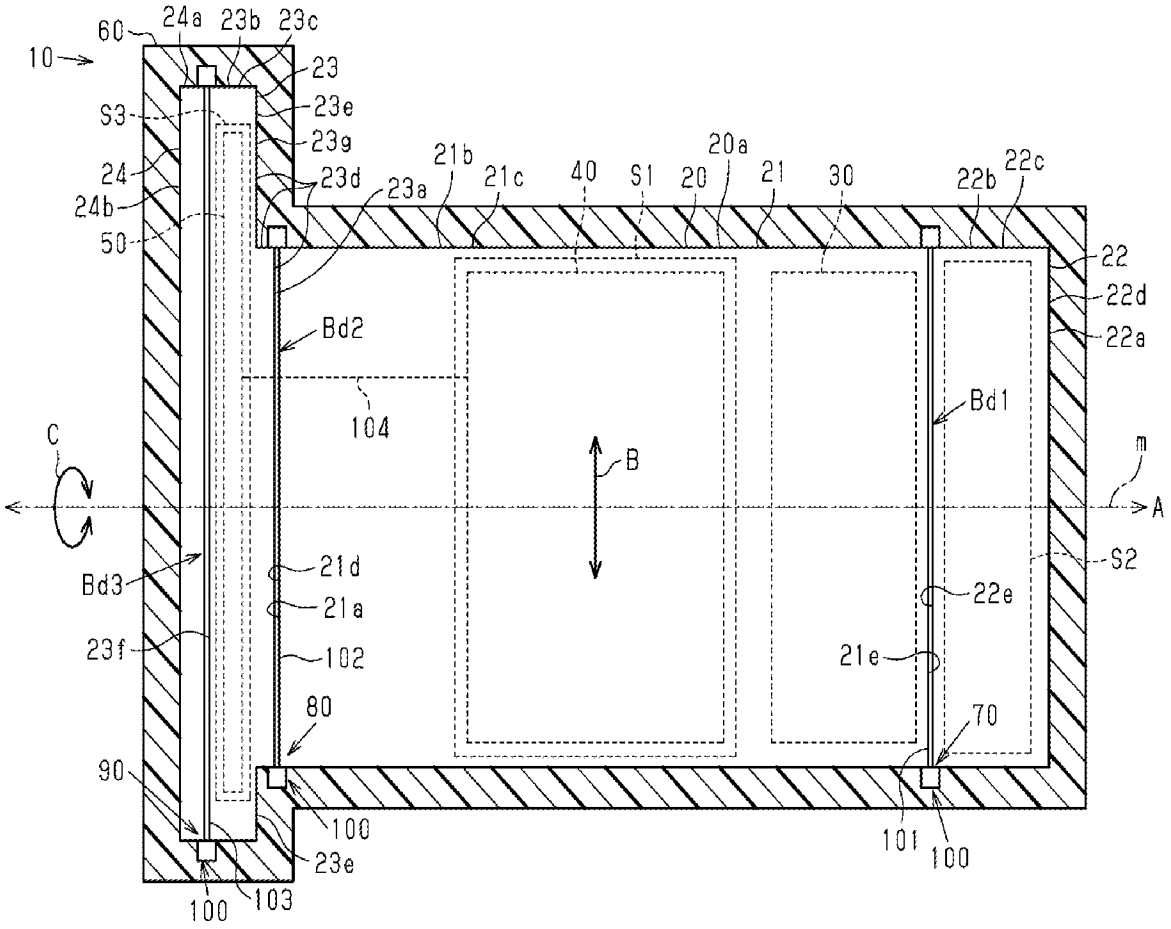
FIG. 1 is a longitudinal cross-sectional view of an electric compressor according to a first embodiment of the present disclosure.

As illustrated in FIG. 1, an electric compressor 10 includes a housing 20 having a cylindrical shape, a compression member 30, an electric motor 40, an inverter 50, and a soundproof cover 60.

A direction in which an axis m of the housing 20 extends is defined as an axial direction A. A direction perpendicular to the axis m of the housing 20 is defined as a radial direction B. A direction in which a circle extends around the axis m of the housing 20 is defined as a circumferential direction C.

The compression member 30 is configured to compress refrigerant as fluid in the present disclosure. The compression member 30 is of a scroll type and formed of a fixed scroll and a movable scroll (not illustrated). The electric motor 40 drives the compression member 30. The compression member 30 is driven by the electric motor 40 to compress the refrigerant flowed into the housing 20.

The inverter 50 drives the electric motor 40. The housing 20 accommodates the compression member 30, the electric motor 40, and the inverter 50. The compression member 30, the electric motor 40, the inverter 50 are arranged in this order in the axial direction A inside the housing 20. The soundproof cover 60 covers the housing 20.

<Housing>

The housing 20 is made of metal, such as aluminum. The housing 20 includes a first housing element 21, a second housing element 22, a third housing element 23, and a fourth housing element 24 corresponding to a plurality of housing elements in the present disclosure. The plurality of housing elements are arranged in the axial direction A.

The first housing element 21 has an end wall 21*a* and a peripheral wall 21*b*. The peripheral wall 21*b* has a cylindrical shape. The peripheral wall 21*b* extends from an outer peripheral portion of the end wall 21*a*. An axis of the peripheral wall 21*b* coincides with the axis m of the housing 20. The peripheral wall 21*b* has an outer peripheral face 21*c*. The end wall 21*a* has an outer face 21*d*. The outer face 21*d* is continuous with the outer peripheral face 21*c*. The first housing element 21 accommodates the compression member 30 and the electric motor 40.

A motor chamber S1 is formed in the first housing element 21. The motor chamber S1 is surrounded by the end wall 21*a* and the peripheral wall 21*b*. The motor chamber S1 accommodates the electric motor 40. The refrigerant to be compressed by the compression member 30 flows into the motor chamber S1. That is, the motor chamber S1 also serves as an intake chamber into which the refrigerant to be compressed by the compression member 30 flows.

The second housing element 22 includes an end wall 22*a* and a peripheral wall 22*b*. The peripheral wall 22*b* has a cylindrical shape. The peripheral wall 22*b* extends from an outer peripheral portion of the end wall 22*a*. The peripheral wall 22*b* has an outer peripheral face 22*c*. The end wall 22*a* has an outer face 22*d*. The outer face 22*d* is continuous with the outer peripheral face 22*c*.

The first housing element 21 is connected to the second housing element 22 in the axial direction A with a first sealing member 101 interposed between the first housing element 21 and the second housing element 22. An end portion 21*e* of the first housing element 21 opposite to the end wall 21*a* across the peripheral wall 21*b* is in contact with an end portion 22*e* of the second housing element 22 opposite to the end wall 22*a* across the peripheral wall 22*b* with the first sealing member 101 interposed between the end portion 21*e* and the end portion 22*e*. The first sealing member 101 is, for example, a gasket. The first housing element 21 and the second housing element 22 are fixed to each other by bolts (not illustrated).

A discharge chamber S2 is formed in the second housing element 22. The refrigerant compressed by the compression member 30 is discharged to the discharge chamber S2. The refrigerant discharged from the compression member 30 to the discharge chamber S2 is further discharged to the outside of the housing 20 through a discharge port (not illustrated). The first sealing member 101 maintains a sealing performance of the discharge chamber S2.

The third housing element 23 includes an end wall 23*a*, a peripheral wall 23*b*, and a bottom wall 23*g*. The bottom wall 23*g* has a plate shape. The peripheral wall 23*b* has a cylindrical shape. The peripheral wall 23*b* extends from an outer peripheral portion of the bottom wall 23*g*. The peripheral wall 23*b* has an outer peripheral face 23*c*. The end wall 23*a* protrudes from a part of the bottom wall 23*g* on a side opposite to the peripheral wall 23*b* in the axial direction A. The end wall 23*a* and the bottom wall 23*g* cooperate to form an outer face 23*d*. The outer face 23*d* of the bottom wall 23*g* is continuous with the outer peripheral face 23*c*.

The third housing element 23 is connected to the first housing element 21 in the axial direction A with a second sealing member 102 interposed between the third housing element 23 and the first housing element 21. The end wall 23*a* of the third housing element 23 is in contact with the end wall 21*a* of the first housing element 21 with the second sealing member 102 interposed between the end wall 23*a* and the end wall 21*a*. The second sealing member 102 is a grommet.

A part of the bottom wall 23*g* of the third housing element 23 protrudes from the first housing element 21 in the radial direction B. A part of 23*d* of the third housing 23 corresponds to an exposed face 23*e* that protrudes from the first housing element 21 in the radial direction B. The third housing element 23 and the first housing element 21 are fixed to each other by bolts (not illustrated).

The fourth housing element 24 closes an opening of the peripheral wall 23*b* of the third housing element 23. The fourth housing element 24 is connected to the third housing element 23 in the axial direction A with a third sealing member 103 interposed between the fourth housing element 24 and the third housing element 23. The fourth housing element 24 is in contact with an end portion 23*f* of the third housing element 23 opposite to the end wall 23*a* across the peripheral wall 23*b* with the third sealing member 103 interposed between the fourth housing element 24 and the end portion 23*f*. The third sealing member 103 is, for example, a gasket. The third housing element 23 and the fourth housing element 24 cooperate to define an inverter chamber S3. The third sealing member 103 maintains a sealing performance of the inverter chamber S3. The inverter chamber S3 accommodates the inverter 50. The housing elements include at least the third housing element 23 as a first inverter chamber element in the present disclosure and the fourth housing element 24 as a second inverter chamber element in the present disclosure, which cooperate to define the inverter chamber S3. The fourth housing element 24 and the third housing element 23 may serve as the first inverter chamber element and the second inverter chamber element in the present disclosure, respectively.

The inverter 50 is electrically connected to the electric motor 40 through hermetically sealed terminals 104. The hermetically sealed terminals 104 are each formed in the end wall 21*a* and the end wall 23*a* and connected to each other to extend through the end wall 23*a* of the third housing element 23, the second sealing member 102, and the end wall 21*a* of the first housing element 21. The hermetically sealed terminals 104 are formed so as to maintain a sealing performance in the motor chamber S1 and the sealing performance in the inverter chamber S3. The second sealing member 102 prevents water from flowing toward the hermetically sealed terminals 104 through a space between the end wall 21*a* and the end wall 23*a*.

The fourth housing element 24 has a first outer face 24*a* and a second outer face 24*b*. The first outer face 24*a* corresponds to an outer peripheral surface of the fourth housing element 24. The second outer face 24*b* does not face the third housing element 23 in the axial direction A. The second outer face 24*b* is continuous with the first outer face 24*a*.

<Boundary Between Two Adjacent Housing Elements>

The housing 20 has a first boundary Bd1, a second boundary Bd2, and a third boundary Bd3. The boundaries Bd1, Bd2, and Bd3 extend over an entire circumference of the housing 20 in the circumferential direction C of the housing 20. The boundaries Bd1, Bd2, and Bd3 each have a ring shape. The boundaries Bd1, Bd2, and Bd3 each correspond to a boundary between the corresponding two housing elements that are adjacent to each other in the present disclosure.

The first boundary Bd1 is a boundary between the end portion 21*e* of the first housing element 21 and the end portion 22*e* of the second housing element 22. In the first embodiment, the first sealing member 101 is provided at the first boundary Bd1.

The second boundary Bd2 is a boundary between the end wall 23*a* of the third housing element 23 and the end wall 21*a* of the first housing element 21. In the first embodiment, the second sealing member 102 is provided at the second boundary Bd2.

The third boundary Bd3 is a boundary between the fourth housing element 24 and the end portion 23*f* of the third housing element 23. In the first embodiment, the third sealing member 103 is provided at the third boundary Bd3. The boundaries in the present disclosure include at least the third boundary Bd3 between the third housing element 23 as the first inverter chamber element and the fourth housing element 24 as the second inverter chamber element.

<Soundproof Cover>

The soundproof cover 60 covers an outer face 20*a* of the housing 20. The outer face 20*a* of the housing 20 is formed of the outer face 22*d*, the outer peripheral face 22*c*, the outer peripheral face 21*c*, a part of the outer face 23*d*, the outer peripheral face 23*c*, the first outer face 24*a*, and the second outer face 24*b*. The outer face 20*a* of the housing 20 forms an outer shape of the housing 20. The soundproof cover 60 is formed along the outer shape of the housing 20.

For example, the soundproof cover 60 is made of elastically deformable resin material, for example, urethane material. The soundproof cover 60 is formed of a first cover body and a second cover body (not illustrated). The soundproof cover 60 may be made of any material as long as the material has a soundproof performance. The soundproof cover 60 is not limited to the resin material, such as the urethane material, and may be made of nonwoven fabric, foamed ethylene propylene rubber, glass wool, or the like. The soundproof cover 60 may have a double-layered structure, such as a structure in which an inner layer is made of urethane and an outer layer is made of resin material other than urethane, or a multi-layered structure having three layers or more. The soundproof cover 60 may be formed of three or more cover bodies.

The soundproof cover 60 has a first facing portion 70, a second facing portion 80, and a third facing portion 90. The facing portions 70, 80, and 90 face the housing 20 in the radial direction B. The first facing portion 70 faces the first boundary Bd1 in the radial direction B. The second facing portion 80 faces the second boundary Bd2 in the radial direction B. The third facing portion 90 faces the third boundary Bd3 in the radial direction B. The facing portions 70, 80, and 90 each have a groove 100 facing the corresponding one of the boundaries Bd1, Bd2, and Bd3.

Figure 2:
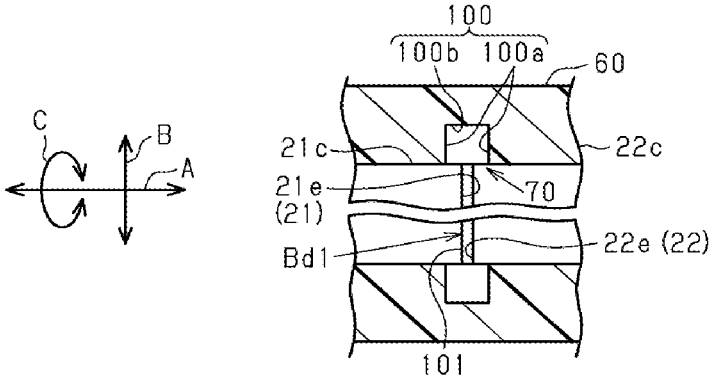
FIG. 2 is an enlarged cross-sectional view illustrating a groove formed in a first facing portion of a soundproof cover according to the first embodiment.
Figure 3:
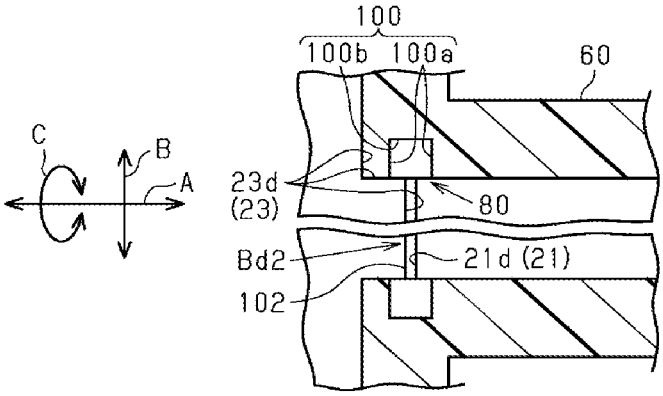
FIG. 3 is an enlarged cross-sectional view illustrating a groove formed in a second facing portion of the soundproof cover according to the first embodiment.
Figure 4:
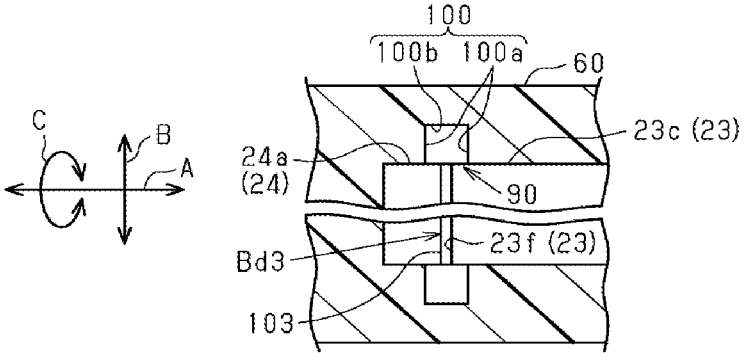
FIG. 4 is an enlarged cross-sectional view illustrating a groove formed in a third facing portion of the soundproof cover according to the first embodiment.

As illustrated in FIGS. 2, 3, and 4, the groove 100 has at least first separation faces 100*a* and a second separation face 100*b*. The first separation faces 100*a* face each other across each of the boundaries Bd1, Bd2, and Bd3 in the axial direction A. The first separation faces 100*a* intersect with two housing elements respectively that are adjacent to each other and cooperate to form each of the boundaries Bd1, Bd2, and Bd3. The first separation faces 100*a* extend in the radial direction B. In the first embodiment, the first separation faces 100*a* each have a ring shape in the circumferential direction C. The first separation faces 100*a* need not extend in the radial direction B. For example, the first separation faces 100*a* may extend in a direction inclined relative to the axial direction A.

The second separation face 100*b* corresponds to a separation face in the present disclosure that is distant from each of the boundaries Bd1, Bd2, and Bd3 in the radial direction B. In the first embodiment, the second separation face 100*b* is continuous with the first separation faces 100*a*, and has a ring shape in the circumferential direction C. That is, the groove 100 surrounds each of the boundaries Bd1, Bd2, and Bd3 and is distant from each of the boundaries Bd1, Bd2, and Bd3. The groove 100 surrounds each of the boundaries Bd1, Bd2, and Bd3 over an entire circumference thereof. The groove 100 is continuously formed along each of the boundaries Bd1, Bd2, and Bd3.

Operation in the First Embodiment

The following will describe an operation of the first embodiment.

In the first embodiment, when the compression member 30 and the electric motor 40 are driven, noise is generated and transmitted to the outside of the housing 20. However, since the housing 20 is covered with the soundproof cover 60, the noise of the electric compressor 10 is reduced.

The groove 100 formed in each of the facing portions 70, 80, and 90 of the soundproof cover 60 keeps the soundproof cover 60 apart from the corresponding one of the boundaries Bd1, Bd2, and Bd3.

Advantageous Effect in the First Embodiment

The following will describe an advantageous effect of the first embodiment.

(1-1) The groove 100 formed in each of the facing portions 70, 80, and 90 keeps the soundproof cover 60 apart from the corresponding one of the boundaries Bd1, Bd2, and Bd3. Water absorbed in the soundproof cover 60 is less likely to remain at each of the boundaries Bd1, Bd2, and Bd3 of the corresponding two adjacent housing elements. This configuration suppresses the proceeding of corrosion into the housing 20.

(1-2) The groove 100 is continuously formed along each of the boundaries Bd1, Bd2, and Bd3. This configuration makes it easy to continuously keep a distance between each of the boundaries Bd1, Bd2, and Bd3 and the corresponding one of the facing portions 70, 80, and 90 in a direction in which each of the boundaries Bd1, Bd2, and Bd3 extends. That is, a portion in which each of the boundaries Bd1, Bd2, and Bd3 and the corresponding one of the facing portions 70, 80, and 90 keep apart from each other is easy to be formed continuously. This configuration suppresses the proceeding of corrosion into the housing 20.

(1-3) Corrosion is less likely to proceed into the housing 20 through the third boundary Bd3 due to the groove 100 formed in the third facing portion 90. That is, corrosion of the third sealing member 103, the end portion 23*f* of the third housing element 23, and the fourth housing element 24 is less likely to proceed. This configuration suppresses a leak of electricity and a stop of a mechanism that drives the electric motor 40, which are caused by water reaching the inverter 50.

(1-4) Corrosion is less likely to proceed into the housing 20 through the first boundary Bd1 due to the groove 100 formed in the first facing portion 70. That is, corrosion of the first sealing member 101, the end portion 21*e* of the first housing element 21, and the end portion 22*e* of the second housing element 22 is less likely to proceed. This configuration suppresses a leak of the refrigerant flowing to the outside of the housing 20 from the discharge chamber S2 through the first boundary Bd1.

(1-5) Corrosion is less likely to proceed into the housing 20 through the second boundary Bd2 due to the groove 100 formed in the second facing portion 80. Corrosion of the second sealing member 102, the end wall 21*a* of the first housing element 21, and the end wall 23*a* of the third housing element 23 is less likely to proceed. This configuration suppresses a leak of electricity of the hermetically sealed terminals 104. Indeed, this configuration suppresses a leak of electricity of the electric motor 40 and the inverter 50 and the stop of the mechanism that drives the electric motor 40.

(1-6) The groove 100 surrounds each of the boundaries Bd1, Bd2, and Bd3 over the entire circumference thereof. The soundproof cover 60 is not in contact with each of the boundaries Bd1, Bd2, and Bd3, so that water does not remain at each of the boundaries Bd1, Bd2, and Bd3. This configuration suppresses the proceeding of corrosion into the housing 20.

Second Embodiment

Figure 5:
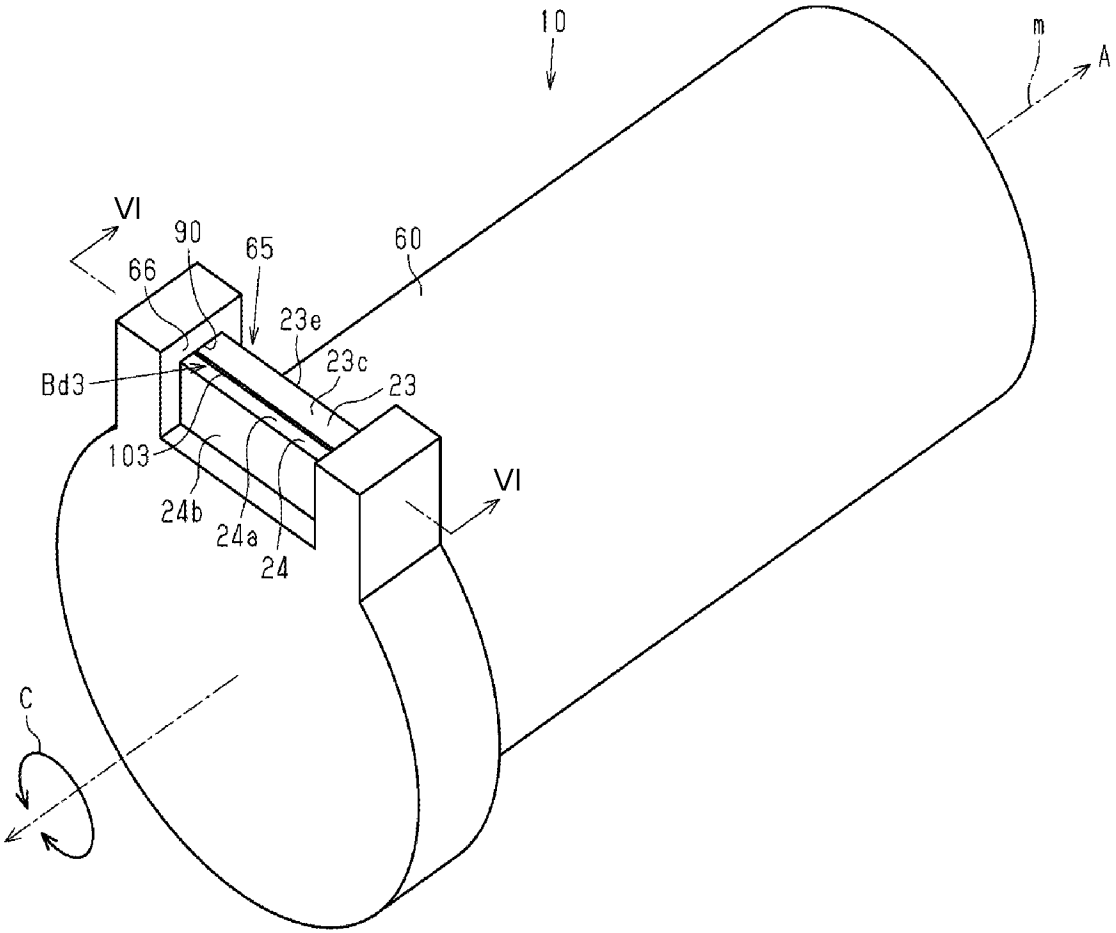
FIG. 5 is a perspective view of an electric compressor according to a second embodiment of the present disclosure.
Figure 6:
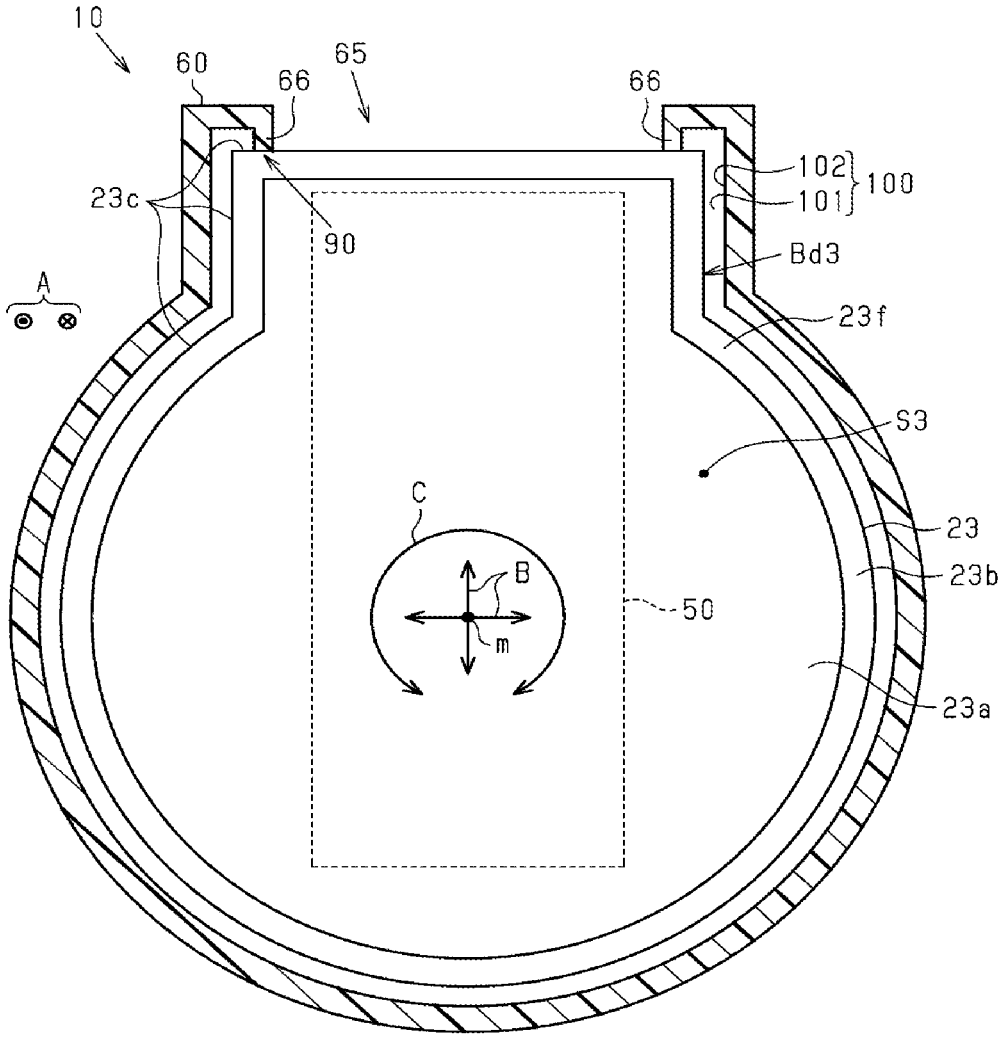
FIG. 6 is a cross-sectional view taken along a line VI-VI of FIG. 5.

The following will describe a second embodiment of the electric compressor with reference to FIGS. 5 and 6. In the second embodiment, the soundproof cover 60 is mainly different from that in the first embodiment. The following will describe such a difference in detail, and identical components to those in the first embodiment are denoted by the same reference numerals and a detailed description of the identical configuration is omitted.

<Soundproof Cover>

As illustrated in FIG. 5, the soundproof cover 60 has an opening portion 65. The opening portion 65 is formed by omitting a part of the soundproof cover 60. The opening portion 65 is formed such that a part of the housing 20 is exposed to the outside through the opening portion 65. The opening portion 65 is formed such that a part of the third boundary Bd3 is exposed to the outside through the opening portion 65. A part of the outer peripheral face 23*c* of the third housing element 23 and a part of the exposed face 23*e* are exposed to the outside through the opening portion 65. A part of the first outer face 24*a* and a part of the second outer face 24*b* of the fourth housing element 24 are exposed to the outside through the opening portion 65.

<Reason for Forming the Opening Portion>

When the electric compressor 10 is mounted on the vehicle, a contact between the electric compressor 10 and the other members mounted on the vehicle needs to be avoided depending on an arrangement and shapes of the other members. The opening portion 65 is formed in the soundproof cover 60 in order to avoid the contact between the electric compressor 10 and the other members.

<Relation Between the Opening Portion and the Groove>

The following will describe a relation between the opening portion 65 and the groove 100 with reference to FIG. 6. FIG. 6 is a cross-sectional view taken along a line VI-VI of FIG. 5 such that a surface of the end portion 23*f* of the third housing element 23 which is in contact with the third sealing member 103 is seen in a front view. The groove 100 described in the following description means the groove 100 formed in the third facing portion 90.

As illustrated in FIG. 6, similarly to the first embodiment, the groove 100 continuously extends along the third boundary Bd3. The groove 100 does not communicate with the opening portion 65. Specifically, the soundproof cover 60 has, in opposite ends of the groove 100, closed portions 66 as a partition that closes the groove 100. The closed portions 66 separate the groove 100 from the opening portion 65. The closed portions 66 are integrally formed with the soundproof cover 60. The closed portions 66 are continuous with the first separation faces 100*a*. The closed portions 66 are in contact with the third boundary Bd3 as well as the outer peripheral face 23*c* and the first outer face 24*a*.

Operation in the Second Embodiment

The following will describe an operation of the second embodiment.

The closed portions 66 closes the opposite ends of the groove 100. The groove 100 does not communicate with the opening portion 65 of the soundproof cover 60 because of the closed portions 66. With this configuration, even when the opening portion 65 is formed in the soundproof cover 60, water is less likely to intrude into the groove 100.

Advantageous Effect in the Second Embodiment

The second embodiment has the same advantageous effects as those described in (1-1), (1-2), (1-3), (1-4), and (1-5) of the first embodiment, and also has the following advantageous effects.

(2-1) Water intruding through the opening portion 65 is less likely to reach the groove 100 due to the closed portions 66. In the second embodiment, the groove 100 does not communicate with the opening portion 65 of the soundproof cover 60 because of the closed portions 66. Accordingly, even when the soundproof cover 60 has the opening portion 65, water is less likely to remain between the soundproof cover 60 and the housing 20.

(2-2) Even when water is attached to the third boundary Bd3 exposed to the outside through the opening portion 65, water is less likely to intrude into the housing 20 due to the third sealing member 103. In addition, even when water is attached to the third boundary Bd3, the water easily flows on the outer peripheral face 23*c* of the third housing element 23 and the first outer face 24*a* of the fourth housing element 24. That is, even when water is easily attached to the third boundary Bd3 because of the opening portion 65, the water is less likely to remain at the third boundary Bd3. This configuration suppresses the proceeding of corrosion into the housing 20. This configuration at least suppresses a leak of electricity which is caused by the water reaching the inverter 50.

Third Embodiment

Figure 7:
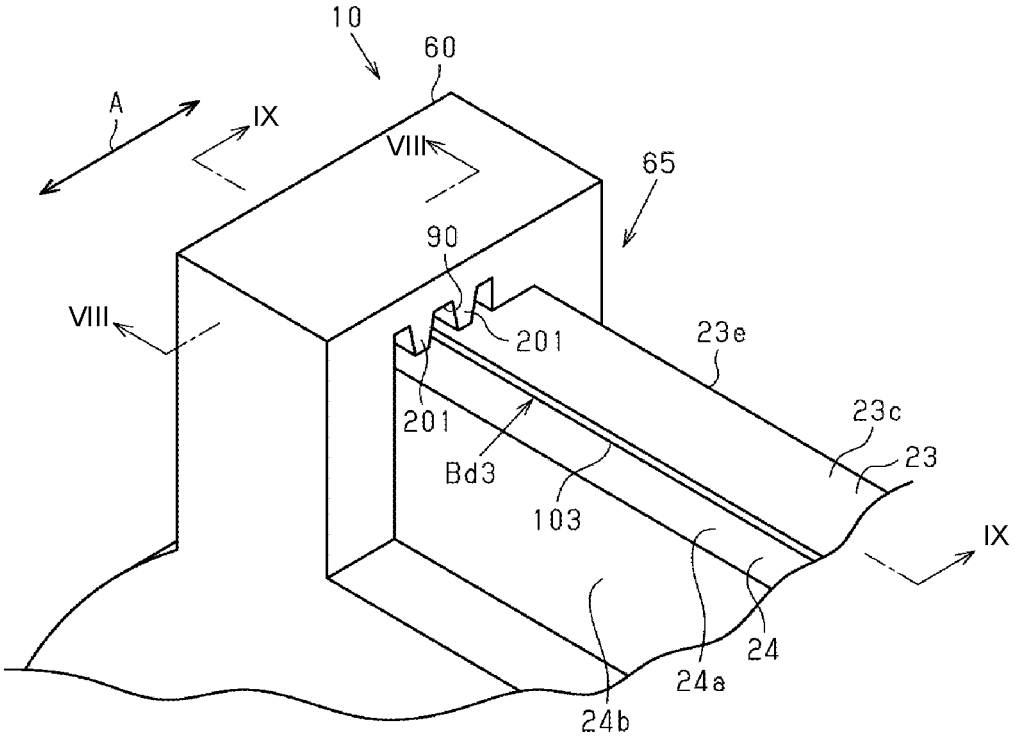
FIG. 7 is an enlarged perspective view illustrating a part of an electric compressor according to a third embodiment of the present disclosure.
Figure 8:
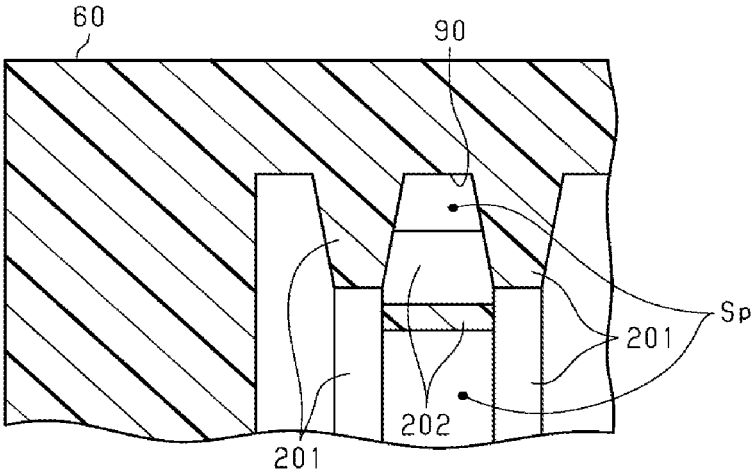
FIG. 8 is a cross-sectional view taken along a line VIII-VIII of FIG. 7.
Figure 9:
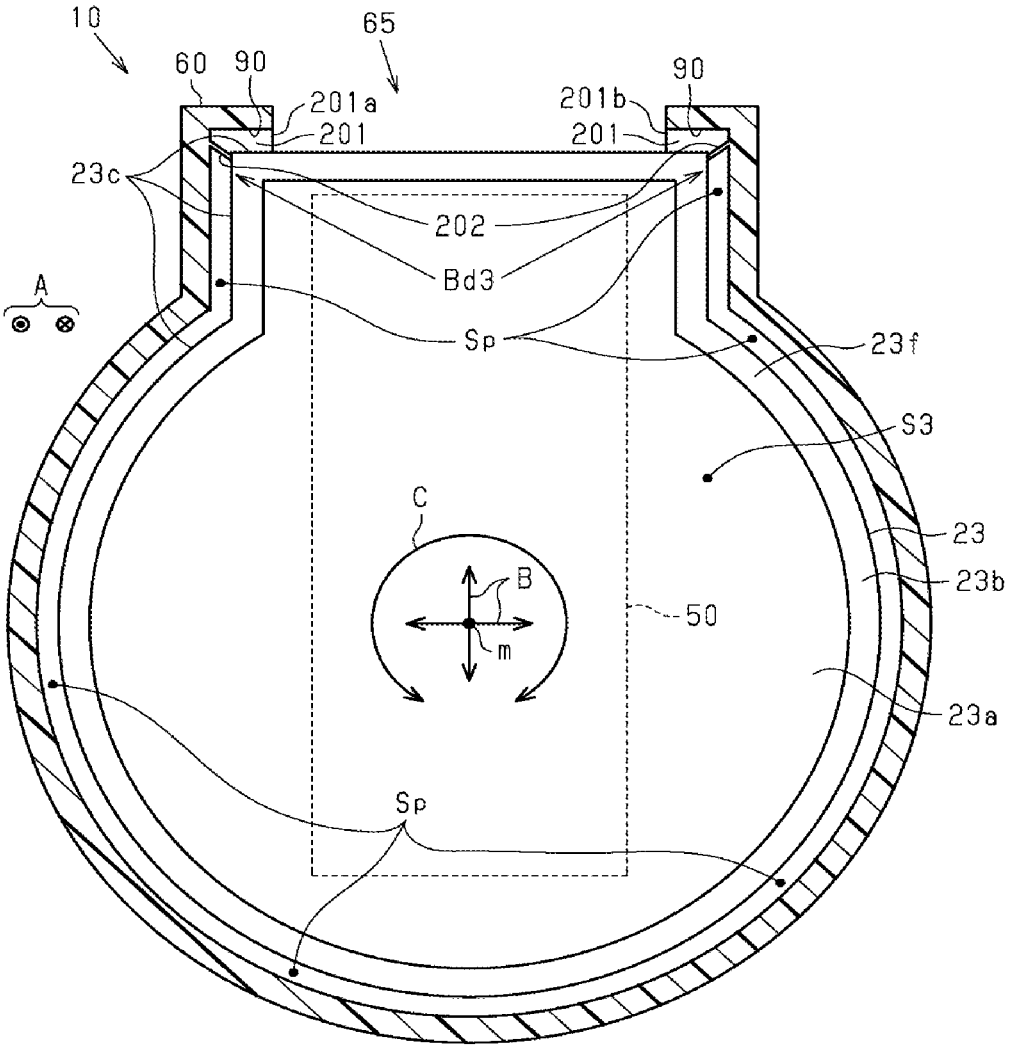
FIG. 9 is a cross-sectional view taken along a line IX-IX of FIG. 7.

The following will describe a third embodiment of the electric compressor with reference to FIGS. 7, 8, and 9. Identical components to those in the first embodiment and the second embodiment is denoted by the same reference numerals and a detailed description of the identical configuration is omitted. FIG. 9 is a cross-sectional view taken along a line IX-IX of FIG. 7 such that the surface of the end portion 23*f* of the third housing element 23 which is in contact with the third sealing member 103 is seen in a front view.

<Soundproof Cover>

As illustrated in FIG. 7, the soundproof cover 60 in the third embodiment basically has the same configuration as that in the second embodiment.

The soundproof cover 60 of the third embodiment lacks the groove 100 formed in the third facing portion 90 of the soundproof cover 60 in the first embodiment and the second embodiment. The electric compressor 10 has two ribs 201 as a spacer in the present disclosure. The ribs 201 are integrally formed with the third facing portion 90. The two ribs 201 are arranged in the axial direction A. The two ribs 201 are disposed such that the third boundary Bd3 is disposed between the two ribs 201. One of the two ribs 201 is in contact with the outer peripheral face 23*c* of the third housing element 23. The other of the two ribs 201 is in contact with the first outer face 24*a* of the fourth housing element 24. The ribs 201 keep the third facing portion 90 apart from the third boundary Bd3.

As illustrated in FIG. 9, each of the ribs 201 continuously extends along the third boundary Bd3. A first end 201*a* of the rib 201 is connected to one side of the opening portion 65 and a second end 201*b* of the rib 201 is connected to the other side of the opening portion 65. A space Sp surrounded by the two ribs 201 and the third facing portion 90 continuously extends along the third boundary Bd3. The space Sp communicates with the opening portion 65.

As illustrated in FIGS. 8 and 9, the soundproof cover 60 has two opening portion ribs 202. The opening portion ribs 202 are integrally formed with the third facing portion 90. The opening portion ribs 202 are disposed so as to be in contact with a part of the third boundary Bd3. The opening portion ribs 202 are disposed near the opening portion 65 in the space Sp. The opening portion ribs 202 are disposed so as to be integrated with the two ribs 201 with the third boundary Bd3 disposed therebetween. The opening portion ribs 202 are integrally formed with the two ribs 201 with the third boundary Bd3 disposed therebetween. In other word, the opening portion ribs 202 are disposed in the space Sp near the opening portion 65 to close the soundproof cover 60.

Operation in the Third Embodiment

The following will describe an operation of the third embodiment.

In the third embodiment, the ribs 201 as the spacer in the present disclosure keeps the third boundary Bd3 between the adjacent housing elements apart from the soundproof cover 60. Accordingly, water absorbed in the soundproof cover 60 is less likely to remain at the third boundary Bd3.

When water intruding into the space Sp through the opening portion 65 of the soundproof cover 60 reaches the opening portion ribs 202, the water is absorbed into the opening portion ribs 202. The water absorbed into the opening portion ribs 202 permeates toward the third facing portion 90.

Advantageous Effect in the Third Embodiment

The third embodiment has the same advantageous effects as those described in (1-4), (1-5) of the first embodiment and (2-2) of the second embodiment, and also has the following advantageous effects.

(3-1) The ribs 201 as the spacer keep the third boundary Bd3 between the adjacent housing elements away from the soundproof cover 60. This configuration suppresses the proceeding of corrosion into the housing 20.

(3-2) The ribs 201 as the spacer are formed as a part of the soundproof cover 60. This configuration keeps the third boundary Bd3 apart from the third facing portion 90 of the soundproof cover 60 when the soundproof cover 60 covers the housing 20. As compared with the case in which the spacer is separately provided from the soundproof cover 60 or the housing 20, it is easy to keep a distance between third boundary Bd3 and the third facing portion 90 of the soundproof cover 60 in a simple manner.

(3-3) The two ribs 201 are disposed such that the third boundary Bd3 is disposed between the two ribs 201 in the axial direction A. Such ribs 201 easily keep the distance between the third boundary Bd3 and the third facing portion 90 of the soundproof cover 60. This configuration further suppresses the proceeding of corrosion into the housing 20.

(3-4) The ribs 201 continuously extending along the third boundary Bd3 make it easy to continuously keep the distance between the third boundary Bd3 and the third facing portion 90 of the soundproof cover 60 in a direction in which the third boundary Bd3 extends. That is, a portion in which the third boundary Bd3 and the third facing portion 90 of the soundproof cover 60 keep apart from each other is easy to be formed continuously. This configuration further suppresses the proceeding of corrosion into the housing 20.

(3-5) The opening portion ribs 202 are disposed near the opening portion 65. The opening portion ribs 202 are connected to the ribs 201. Even when the soundproof cover 60 has the opening portion 65, water absorbed into the opening portion ribs 202 are introduced into the ribs 201. That is, the flowing of the water intruding through the opening portion 65 is controlled by the opening portion ribs 202. The water intruding through the opening portion 65 is less likely to reach a part of the third boundary Bd3 which is not exposed on the outside. Accordingly, the water absorbed in the opening portion ribs 202, hence the water absorbed in the soundproof cover 60 is less likely to remain at a part of the third boundary Bd3 which is not exposed on the outside.

(3-6) When water intruding into the space Sp through the opening portion 65 reaches the opening portion ribs 202, the water is absorbed into the opening portion ribs 202. Even when the soundproof cover 60 has the opening portion 65, the water is less likely to remain between the soundproof cover 60 and the housing 20.

(3-7) The opening portion ribs 202 are disposed so as to be integrated with the two ribs 201 with the third boundary Bd3 disposed therebetween. When the water intruding through the opening portion 65 flows into a gap between the two ribs 201 with the third boundary Bd3 disposed between the two ribs 201, the flowing of the water is blocked by the opening portion ribs 202. That is, water is less likely to intrude further ahead through the opening portion ribs 202 in the circumferential direction C of the housing 20.

(3-8) The opening portion ribs 202 are integrally formed with the two ribs 201 with the third boundary Bd3 disposed therebetween. When water intruding through the opening portion 65 flows into the gap between the two ribs 201 with the third boundary Bd3 disposed between the two ribs 201, the flowing of the water is blocked by the opening portion ribs 202. The water absorbed into the opening portion ribs 202 permeates the ribs 201 as well as the third facing portion 90. That is, the water is less likely to remain at the opening portion ribs 202. Accordingly, even when the opening portion ribs 202 are in contact with the third boundary Bd3, corrosion is less likely to proceed at portions of the housing 20 which are in contact with the opening portion ribs 202.

Modification

The above-described embodiments may be modified as described below.

The above-described embodiments and the following modifications may be combined with each other as long as they do not technically contradict each other.

In the first embodiment and the second embodiment, the groove 100 only needs to be formed in at least one of the facing portions 70, 80, and 90. That is, as long as the soundproof cover 60 has the groove 100 surrounding at least one of the boundaries Bd1, Bd2, and Bd3, the proceeding of corrosion into the housing 20 is at least suppressed. The at least one of the facing portions 70, 80, and 90 includes only the first facing portion 70, only the second facing portion 80, only the third facing portion 90, a combination of two selected from the facing portions 70, 80, and 90, and all of the facing portions 70, 80, and 90.

In the second embodiment, a portion of the housing 20 exposed to the outside through the opening portion 65 may be only the part of the outer peripheral face 23*c* of the third housing element 23 and only the part of the first outer face 24*a* of the fourth housing element 24, for example.

In the second embodiment, the soundproof cover 60 may have the opening portion 65 that is formed such that a part of the first boundary Bd1 is exposed to the outside. When the soundproof cover 60 has the above-described opening portion 65, a part of the outer peripheral face 21*c* of the first housing element 21 and a part of the outer peripheral face 22*c* of the second housing element 22 are exposed to the outside.

The soundproof cover 60 may have the opening portion 65 that is formed such that a part of the second boundary Bd2 is exposed to the outside. When the soundproof cover 60 has the above-described opening portion 65, a part of the outer peripheral face 21*c* of the first housing element 21 and a part of the outer face 23*d* of the third housing element 23 are exposed to the outside. The number of the opening portions 65 formed in the soundproof cover 60 may be changed as appropriate. For example, the number of the opening portions 65 may be changed as appropriate depending on the number of contact portions between the electric compressor 10 and each of the other members mounted on an object to be attached, such as the vehicle.

In the second embodiment, the soundproof cover 60 may have the opening portion 65 through which none of the three boundaries, that is, the first boundary Bd1, the second boundary Bd2, and the third boundary Bd3 is exposed to the outside. The above-described opening portion 65 is formed so as not to communicate with the groove 100. With this configuration, even when the soundproof cover 60 has the opening portion 65, water is less likely to intrude into the groove 100 through the opening portion 65. Accordingly, the water intruding through the opening portion 65 is less likely to remain at each of the boundaries Bd1, Bd2, and Bd3 between the corresponding two adjacent housing elements.

In the present modification, the configuration for blocking the communication between the opening portion 65 and the groove 100 corresponds to the partition formed in the soundproof cover 60. When the housing 20 and a part of soundproof cover 60 interposed between the groove 100 and the opening portion 65 are in close contact with each other, the part of the soundproof cover 60 corresponds to the partition. When a slight distance is present between the housing 20 and the soundproof cover 60 disposed between the groove 100 and the opening portion 65, a new partition which protrudes to the housing 20 from the soundproof cover 60 is preferably provided. With this configuration, water intruding through the opening portion 65 is less likely to reach the groove 100 due to the partition. Even when the opening portion 65 is formed in the soundproof cover 60, water is less likely to intrude into the groove 100, that is, to remain between the soundproof cover 60 and the housing 20.

In the second embodiment, the closed portions 66 need not be formed in the opposite ends of the groove 100, and may be formed in any portion of the groove 100. In the above-described modification, the closed portions 66, in a portion of the soundproof cover 60 in which the opening portion 65 is formed, may be formed such that the opening portion 65 does not communicate with the groove 100.

In the third embodiment, the opening portion ribs 202 need not be integrally formed with the two ribs 201. For example, the opening portion ribs 202 may be provided such that the opening portion ribs 202 are in contact with the two ribs 201 or the opening portion ribs 202 are not in contact with the two ribs 201. The opening portion ribs 202 only need to be in contact with the third boundary Bd3.

In the third embodiment, the opening portion ribs 202 need not be disposed near the opening portion 65. For example, the opening portion ribs 202 only need to be disposed in any position of the space Sp to close the soundproof cover 60.

In the third embodiment, the opening portion 65 of the soundproof cover 60 may be omitted. Here, the two ribs 201 may each have a ring shape that extends over the entire circumference of the third boundary Bd3. When the two ribs 201 each have the ring shape, the opening portion ribs 202 may be omitted.

In the third embodiment, one of the two ribs 201 may be omitted. The only one rib 201 formed in the soundproof cover 60 needs to be in contact with a vicinity of the third boundary Bd3 in order to surely keep the third facing portion 90 apart from the third boundary Bd3.

In the third embodiment, the groove 100 may be omitted from the first facing portion 70, and the two ribs 201 may be integrally formed with the first facing portion 70. The two ribs 201 formed in the first facing portion 70 may keep the first facing portion 70 apart from the first boundary Bd1. When the opening portion 65 is formed such that the first boundary Bd1 is exposed to the outside, the opening portion ribs 202 are integrally formed with the first facing portion 70. The opening portion ribs 202 integrally formed with the first facing portion 70 are brought into contact with the first boundary Bd1. In the present modification, similarly to the above-described modification, one of the two ribs 201 may be omitted.

In the third embodiment, the groove 100 may be omitted from the second facing portion 80, and the two ribs 201 may be integrally formed with the second facing portion 80. The two ribs 201 formed in the second facing portion 80 may keep the second facing portion 80 apart from the second boundary Bd2. When the opening portion 65 is formed such that the second boundary Bd2 is exposed to the outside, the opening portion ribs 202 are integrally formed with the second facing portion 80. The opening portion ribs 202 integrally formed with the second facing portion 80 are brought into contact with the second boundary Bd2. In the present modification, similarly to the above-described modification, one of the two ribs 201 may be omitted.

In the third embodiment, the ribs 201 continuously extends along the third boundary Bd3. However, the ribs 201 are not limited to this configuration. For example, the ribs 201 may be intermittently disposed along the third boundary Bd3. Here, a distance between the ribs 201 adjacent to each other along the third boundary Bd3 may be set so that the space Sp between the third facing portion 90 and the third boundary Bd3 continuously extends along the third boundary Bd3. The ribs 201 may be intermittently disposed along the third boundary Bd3, and the space Sp may intermittently extend along the third boundary Bd3.

In the third embodiment and the above-described modifications, the ribs 201 only need to be formed in at least one of the facing portions 70, 80, and 90. That is, at least one of a combination of the first facing portion 70 and the first boundary Bd1, a combination of the second facing portion 80 and the second boundary Bd2, and a combination of the third facing portion 90 and the third boundary Bd3 only needs to keep apart from each other by the ribs 201.

In the third embodiment and the above-described modifications, the soundproof cover 60 may have the opening portion 65 through which none of the three boundaries, that is, the first boundary Bd1, the second boundary Bd2, and the third boundary Bd3 is exposed to the outside. Also in this case, the opening portion ribs 202 are formed near the opening portion 65. The opening portion ribs 202 are connected to the ribs 201. With this configuration, even when the soundproof cover 60 has the opening portion 65, water absorbed into the opening portion ribs 202 are introduced into the ribs 201. That is, the flowing of water intruding through the opening portion 65 is controlled by the opening portion ribs 202. The water intruding through the opening portion 65 is less likely to reach each of the boundaries Bd1, Bd2, and Bd3. Accordingly, water absorbed through the opening portion ribs 202, hence water absorbed in the soundproof cover 60 is less likely to remain at each of the boundaries Bd1, Bd2, and Bd3.

In the present modification, the opening portion ribs 202 need not be connected to the ribs 201. As long as the opening portion ribs 202 control the flowing of water intruding through the opening portion 65, an arrangement and a shape of the opening portion ribs 202 may be changed as appropriate.

In the third embodiment, an arrangement of the ribs 201 may be changed as described below.

Figure 10:
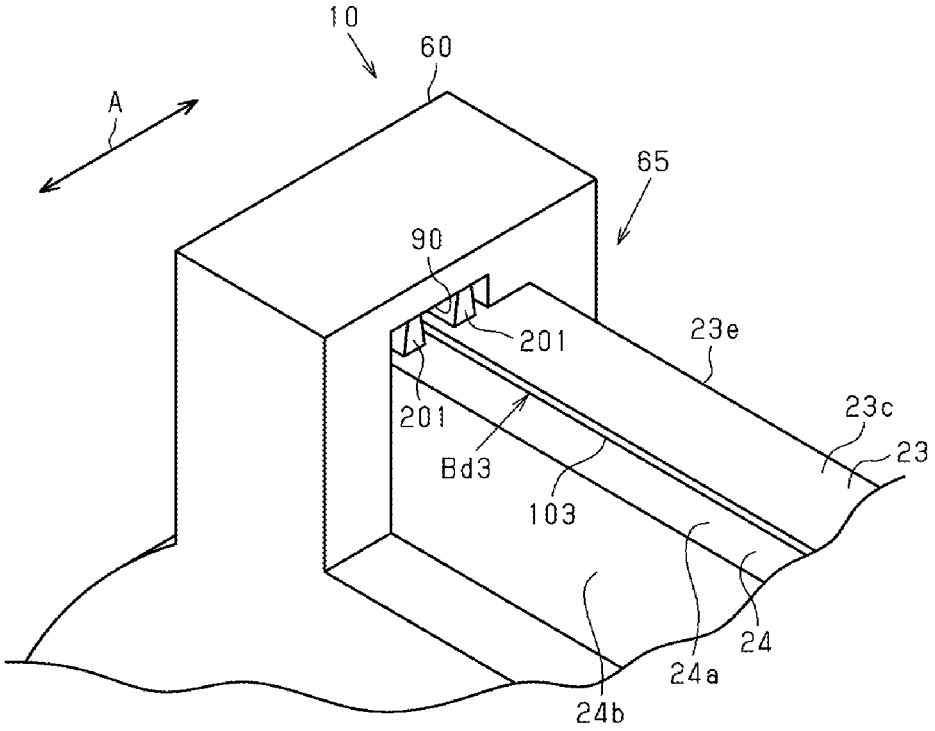
FIG. 10 is an enlarged perspective view illustrating a part of an electric compressor according to a modification.

As illustrated in FIG. 10, the two ribs 201 of the soundproof cover 60 may be omitted, and the two ribs 201 may be formed in the housing 20 as the spacer. One of the two ribs 201 is integrally formed with the third housing element 23. The other of the two ribs 201 is integrally formed with the fourth housing element 24. That is, the ribs 201 are integrally formed with the two adjacent housing elements that cooperate to form the third boundary Bd3. The one of the two ribs 201 projects from the outer peripheral face 23*c* of the third housing element 23 toward the third facing portion 90. The other of the two ribs 201 projects from the first outer face 24*a* of the fourth housing element 24 toward the third facing portion 90.

In the present modification, the two ribs 201 may be continuously formed along the third boundary Bd3 or intermittently disposed along the third boundary Bd3. The space Sp may be also continuously formed along the third boundary Bd3 or intermittently disposed along the third boundary Bd3.

In this modification, the ribs 201 correspond to a part of the third housing element 23 and a part of the fourth housing element 24. When the soundproof cover 60 covers the housing 20, the ribs 201 formed in the third housing element 23 and the fourth housing element 24 push the soundproof cover 60. For this reason, the ribs 201 keep the third facing portion 90 of the soundproof cover 60 apart from the third boundary Bd3 when the soundproof cover 60 covers the housing 20. As compared with the case in which the spacer is separately provided from the soundproof cover 60 or the housing 20, the ribs 201 in the third embodiment and the present modification easily keep a distance between third boundary Bd3 and the third facing portion 90 of the soundproof cover 60 in a simple manner.

In the above-described modification, when the opening portion 65 is formed in the soundproof cover 60 in addition to the ribs 201 formed in the housing 20, the opening portion ribs 202 may be disposed so as to be in contact with the two ribs 201. That is, the opening portion ribs 202 may be disposed so as to be integrated with the two ribs 201. In the present modification, one of the two ribs 201 may be omitted. The rib 201 only needs to be integrally formed with at least one of the two adjacent housing elements that cooperate to form the third boundary Bd3.

In the above-described modification, the ribs 201 integrally formed with the housing 20 may be integrally formed with at least one of the two adjacent housing elements that cooperate to form the first boundary Bd1 or the second boundary Bd2. As long as the at least one of the combination of the first facing portion 70 and the first boundary Bd1, the combination of the second facing portion 80 and the second boundary Bd2, and the combination of the third facing portion 90 and the third boundary Bd3 keeps apart from each other by the ribs 201 integrally formed with the housing 20, an arrangement of the ribs 201 may be changed as appropriate.

In the third embodiment and the above-described modifications, the ribs 201 are used as the spacer. The spacer may be separately provided from the soundproof cover 60 and the housing 20. As long as the at least one of the combination of the first facing portion 70 and the first boundary Bd1, the combination of the second facing portion 80 and the second boundary Bd2, and the combination of the third facing portion 90 and the third boundary Bd3 keeps apart from each other by the spacer, a shape and an arrangement of the member separately provided as the spacer are not particularly limited.

In the above-described embodiments, each of the sealing members 101, 102, and 103 may be omitted. Here, the first boundary Bd1 is formed at a position in which the end portion 21*e* of the first housing element 21 and the end portion 22*e* of the second housing element 22 are in contact with each other. The second boundary Bd2 is formed at a position in which the end wall 23*a* of the third housing element 23 and the end wall 21*a* of the first housing element 21 are in contact with each other. The third boundary Bd3 is formed at a position in which the fourth housing element 24 and the end portion 23*f* of the third housing element 23 are in contact with each other.

In the above-described embodiments, the first housing element 21 may be integrally formed with the third housing element 23. Here, since the second boundary Bd2 is omitted, the groove 100 formed in the second facing portion 80 in the first embodiment and the second embodiment is also omitted. In the above-described modification, the two ribs 201 for keeping the second facing portion 80 apart from the second boundary Bd2 and the member separately provided as the spacer are omitted.

In the above-described embodiments, the compression member 30 is not limited to a compression member of a scroll type. The compression member 30 may be of a piston type or a vane type, for example.

In the above-described embodiments, the electric compressor 10 may be mounted on a fuel cell vehicle and compress air as fluid that is supplied to a fuel cell by the compression member 30.

What is claimed is:

1. An electric compressor comprising:
a compression member configured to compress fluid;
an electric motor configured to drive the compression member;
an inverter configured to drive the electric motor;
a housing accommodating the compression member, the electric motor, and the inverter; and
a soundproof cover covering the housing,
the housing including a plurality of housing elements, wherein
the soundproof cover has a facing portion facing the housing, and
the facing portion has a groove that surrounds a boundary between two of the housing elements that are adjacent to each other and is distant from the boundary.

2. The electric compressor according to claim 1, wherein
the groove is continuously formed along the boundary.

3. The electric compressor according to claim 1, wherein
the soundproof cover has:
an opening portion through which a part of the housing is exposed to an outside; and
partitions separating the groove from the opening portion.

4. The electric compressor according to claim 1, wherein
the housing elements include a first inverter chamber element and a second inverter chamber element which cooperate to define an inverter chamber accommodating the inverter, and
the boundary is formed at least between the first inverter chamber element and the second inverter chamber element.

5. An electric compressor comprising:
a compression member configured to compress fluid;
an electric motor configured to drive the compression member;
an inverter configured to drive the electric motor;
a housing accommodating the compression member, the electric motor, and the inverter; and
a soundproof cover covering the housing,
the housing including a plurality of housing elements, wherein
the soundproof cover has a facing portion facing the housing,
the soundproof cover further has a spacer that keeps a boundary between two of the housing elements that are adjacent to each other apart from the facing portion,
the spacer is a rib integrally formed with the facing portion,
the rib includes two ribs, and
the two ribs are disposed such that the boundary is disposed between the two ribs.

6. The electric compressor according to claim 5, wherein
the rib continuously extends along the boundary.

7. The electric compressor according to claim 5, wherein
the soundproof cover has:
an opening portion through which a part of the housing is exposed to an outside; and
opening portion ribs that are integrally formed with the facing portion and disposed near the opening portion, and
the opening portion ribs are connected to the rib.

8. The electric compressor according to claim 7, wherein
the opening portion through which a part of the boundary is exposed to the outside, and
the opening portion ribs are disposed so as to be in contact with a part of the boundary.

9. The electric compressor according to claim 8, wherein
the two ribs are disposed such that the boundary is disposed between the two ribs, and
the opening portion ribs are disposed so as to be integrated with the two ribs with the boundary disposed between the two ribs.

10. The electric compressor according to claim 6, wherein
the soundproof cover has:
an opening portion through which a part of the boundary is exposed to an outside; and
opening portion ribs that are integrally formed with the facing portion and disposed so as to be in contact with a part of the boundary, and
the opening portion ribs are disposed so as to be integrated with the two ribs with the boundary disposed between the two ribs.

11. The electric compressor according to claim 5, wherein
the housing elements include a first inverter chamber element and a second inverter chamber element which cooperate to define an inverter chamber accommodating the inverter, and
the boundary is formed at least between the first inverter chamber element and the second inverter chamber element.

12. An electric compressor comprising:
a compression member configured to compress fluid;
an electric motor configured to drive the compression member;
an inverter configured to drive the electric motor;
a housing accommodating the compression member, the electric motor, and the inverter; and
a soundproof cover covering the housing,
the housing including a plurality of housing elements, wherein
the soundproof cover has a facing portion facing the housing,
the soundproof cover further has a spacer that keeps a boundary between two of the housing elements that are adjacent to each other apart from the facing portion, and
the spacer is a rib integrally formed with at least one of the two of the housing elements that are adjacent to each other and cooperate to form the boundary.

13. The electric compressor according to claim 12, wherein
the housing elements include a first inverter chamber element and a second inverter chamber element which cooperate to define an inverter chamber accommodating the inverter, and
the boundary is formed at least between the first inverter chamber element and the second inverter chamber element.

* * * * *